US009153903B2

(12) United States Patent
Yuan et al.

(10) Patent No.: US 9,153,903 B2
(45) Date of Patent: Oct. 6, 2015

(54) ELECTRICAL CONNECTOR CONFRONTING WITH DIFFERENT MATING ELECTRICAL CONNECTORS

(71) Applicant: HON HAI PRECISION INDUSTRY CO., LTD., New Taipei (TW)

(72) Inventors: Wei Yuan, Shenzhen (CN); Yu-San Hsiao, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 51 days.

(21) Appl. No.: 14/161,565

(22) Filed: Jan. 22, 2014

(65) Prior Publication Data

US 2014/0206236 A1 Jul. 24, 2014

(51) Int. Cl.

| | |
|---|---|
| ***H01R 24/00*** | (2011.01) |
| ***H01R 13/627*** | (2006.01) |
| *H01R 13/642* | (2006.01) |
| *H01R 107/00* | (2006.01) |

(52) U.S. Cl.

CPC ..... *H01R 13/627* (2013.01); *H01R 13/642* (2013.01); *H01R 2107/00* (2013.01)

(58) Field of Classification Search

CPC . H01R 13/627; H01R 13/642; H01R 2107/00

USPC ..... 439/83, 660

See application file for complete search history.

(56) References Cited

U.S. PATENT DOCUMENTS

| | | | | |
|---|---|---|---|---|
| 8,641,455 | B2 * | 2/2014 | Lan | 439/660 |
| 8,961,192 | B2 * | 2/2015 | Swedberg | 439/65 |
| 9,022,805 | B2 * | 5/2015 | Lai et al. | 439/596 |
| 2012/0322291 | A1 | 12/2012 | Chang et al. | |

FOREIGN PATENT DOCUMENTS

| | | |
|---|---|---|
| TW | D116151 | 4/2007 |

* cited by examiner

*Primary Examiner* — Khiem Nguyen

(74) *Attorney, Agent, or Firm* — Wei Te Chung; Ming Chieh Chang

(57) ABSTRACT

An electrical connector defining a mating direction, includes an insulative housing a plurality of contacts retained in the insulative housing. The insulative housing includes several side walls and a bottom wall connecting the side walls and a mating space surrounded by the side walls and bottom wall. Each contact comprises a contacting portion received in the mating space and a mounting portion protruding perpendicularly from to run through the bottom wall. One of the side walls defines at least an opening and the opening extends along a direction parallel to the contacts and runs through the bottom wall. The opening defines a retaining surface facing to the bottom wall.

4 Claims, 3 Drawing Sheets

ELECTRICAL CONNECTOR CONFRONTING WITH DIFFERENT MATING ELECTRICAL CONNECTORS

BACKGROUND OF THE INVENTION

1. FIELD OF THE INVENTION

The present invention relates to an electrical connector.

2. DESCRIPTION OF RELATED ART

Electrical connector is widely used in the electrical field. Chinese Utility Publication No. 102832500A discloses an electrical connector, including an insulative housing and several contact received in the insulative housing. The insulative housing defines several side walls. One of the side walls defines a recess while a corresponding side wall includes a pair of protrusions. The recess and protrusions are used to mechanically connect to a butting connector. However, the electrical connector fails to mate with different mating connectors having different shapes or outlines.

Hence, an improved electrical connector is desired.

BRIEF SUMMARY OF THE INVENTION

Accordingly, an object of the present invention is to provide an electrical connector confronting with different electrical connectors.

To achieve the above object, an electrical connector defining a mating direction, includes an insulative housing a plurality of contacts retained in the insulative housing. The insulative housing includes several side walls and a bottom wall connecting the side walls and a mating space surrounded by the side walls and bottom wall. Each contact comprises a contacting portion received in the mating space and a mounting portion protruding perpendicularly from to run through the bottom wall. One of the side walls defines at least an opening and the opening extends along a direction parallel to the contacts and runs through the bottom wall. The opening defines a retaining surface facing to the bottom wall.

DETAILED DESCRIPTION OF THE PREFERRED EMBODIMENTS

Figure 1:
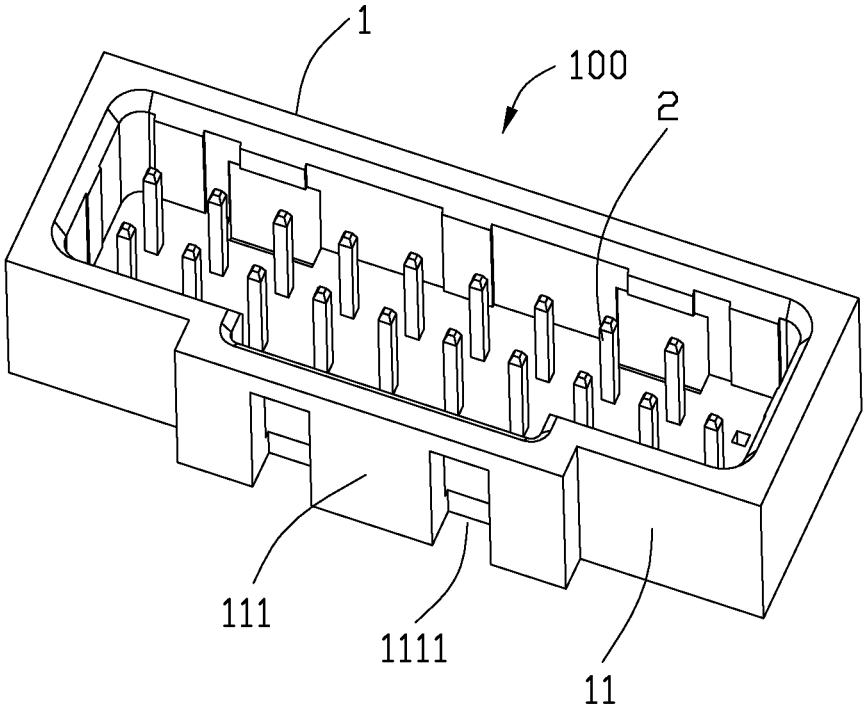
FIG. 1 is an assembled view of an electrical connector of a preferred embodiment of the present invention.
Figure 2:
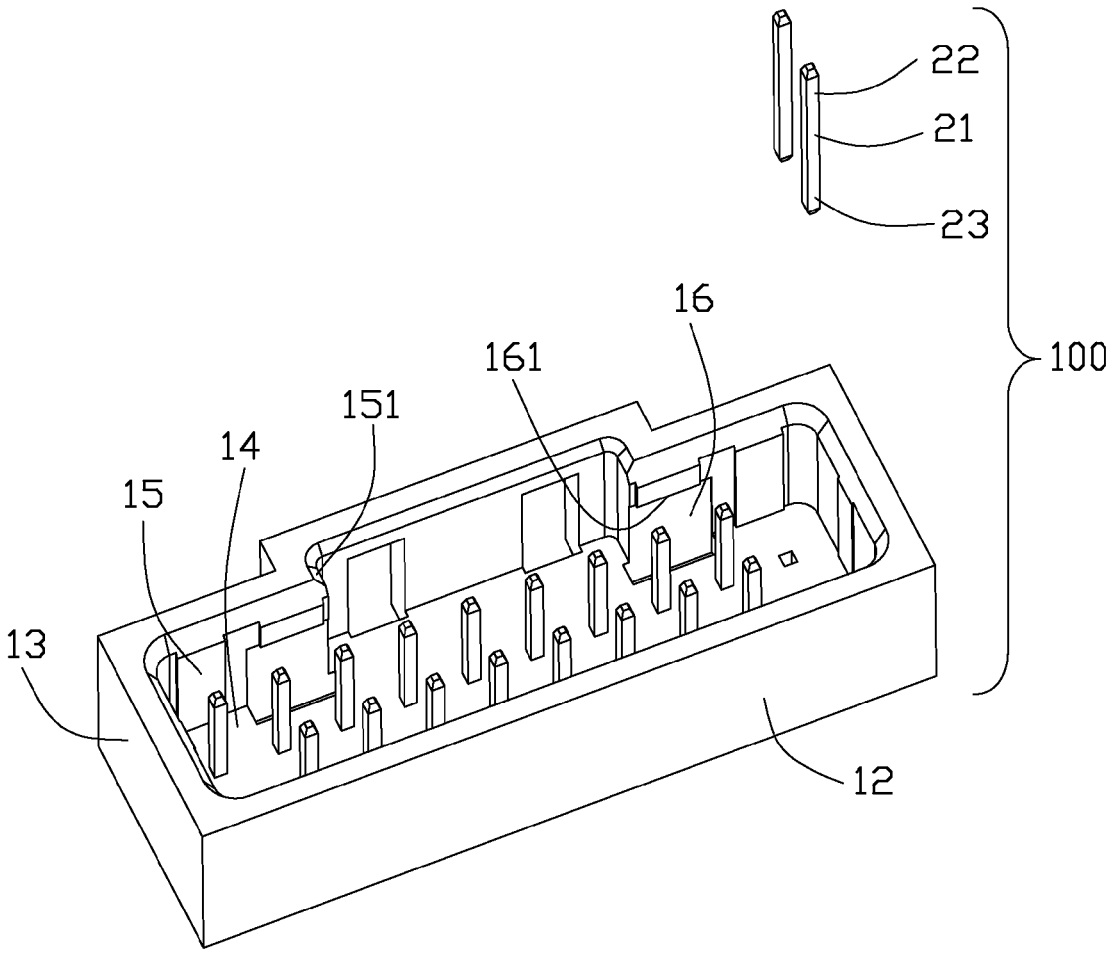
FIG. 2 is a second assembled view of the electrical connector in a second view as shown in FIG. 1.
Figure 3:
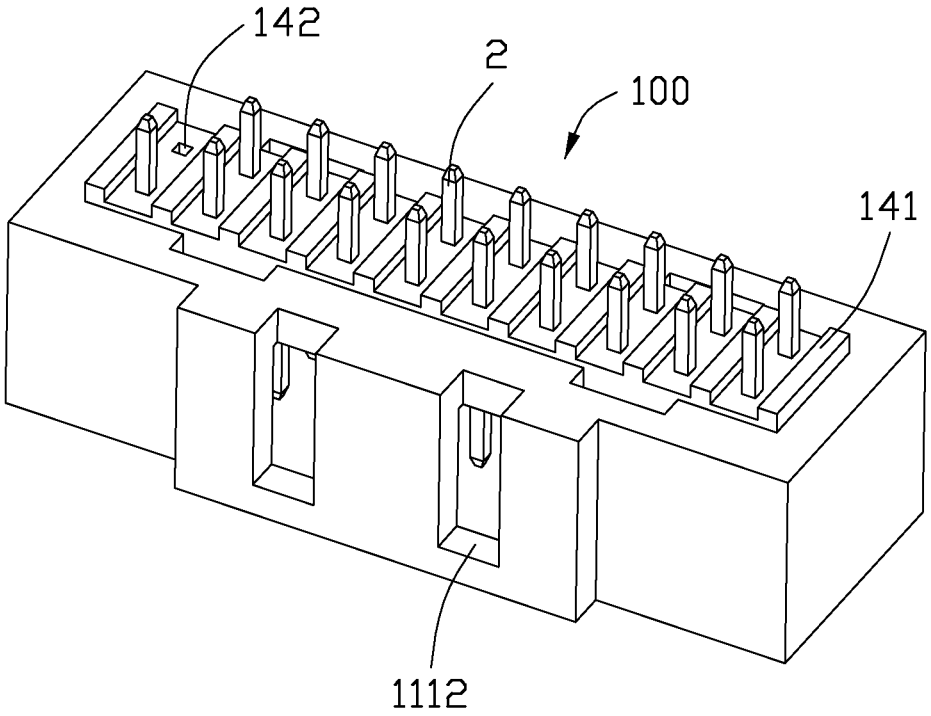
FIG. 3 is a third assembled view of the electrical connector in a third view as shown in FIG. 1.

Reference will now be made to the drawing figures to describe the preferred embodiment of the present invention in details. FIGS. 1~3 illustrate an electrical connector 100 defining a mating direction. The electrical connector 100 includes an insulative housing 1, and several contacts 2 retained in the insulative housing.

Reference to FIGS. 1~2, the insulative housing 1 includes a first side wall 11, a corresponding second side wall 12 opposite to the first side wall 11, a pair of end walls 13 connecting the first and second side walls at opposite ends thereof, and a bottom wall 14 jointed said side walls 11, 12 and end walls 13. A mating space 15 is formed and surrounded by the side walls, end walls and bottom wall. The mating space defines a guiding port 151 depressed from the first side wall 11. The guiding port 151 is aligned with the first side wall. The electrical connector is able to mate with a mating electrical connector with a rectangular interface or a rectangular interface with a guiding element responding to the guiding port 151.

The first side wall defines a protrusion 111 projecting from the first side wall 11 along a direction away from the second side wall 12. The protrusion 111 is used to retain a mating electrical connector (not shown). The protrusion 111 is aligned with the first side wall 11 in the mating direction. An opening 1111 runs through the protrusion 111 and the bottom wall 14, but fails to run through the top face of the protrusion. The opening defines a retaining face 1112 facing to the bottom wall.

Combining with FIGS. 2, the insulating housing defines guiding/confining elements (not labeled) adjacent to its top face. Recesses 16 are formed under the guiding elements and each defines a stopping face 161.

The bottom wall 14 defines a plurality through holes 142 for holding the retaining portions 21. The through holes are divided into several pairs by several partition walls 141 protruding from the bottom wall 14. One mounting portion 23 of each pairs of the contacts stands in a row, while the other ones stand in another row. The contacting portions 22 are disposed in the mating space 15. One of the through holes doesn't receive any contact for anti-misplug of the mating electrical connector.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector defining a mating direction, comprising: an insulative housing comprising several side walls, a bottom wall connecting with the side walls, and a mating space surrounded by the side walls and bottom wall; and a plurality of contacts retained in the insulative housing, each comprising a contacting portion received in the mating space and a mounting portion protruding perpendicularly from the mating space to run through the bottom wall; wherein one of the side walls defines at least an opening, the opening extends along a direction parallel to the contacts and runs through the bottom wall, the opening defines a retaining face facing to the bottom wall, wherein a protrusion projects from said side wall and defines said opening, wherein the mating space defines a guiding port aligned with said side wall along a side direction perpendicular to the mating direction, wherein the contacts is divided into two rows and quantity of the two rows is different.

2. The electrical connector as claimed in claim 1, wherein the bottom wall defines a mounting face and several partition walls extending from the mounting face along said mating direction, the mounting portions of each row are spaced from each other by the partition walls.

3. An electrical connector comprising: an insulative housing defining a bottom wall, a pair of opposite long side walls along the longitudinal direction, and a pair of short side walls along the transverse direction perpendicular to said longitudinal direction, both said long side walls and said short side walls extending from a periphery of the bottom wall to commonly define a rectangular mating cavity to communicate with an exterior in a vertical direction perpendicular to both said longitudinal direction and said transverse direction, one of said long side walls defines a protrusion outwardly projecting in the transverse direction with therein a recessed guiding port communicating inwardly with the mating cavity in the transverse direction, said protrusion defining an opening extending therethrough in the transverse direction, and further through the bottom wall while terminated before reaching a top face of the housing in the vertical direction; and a plurality of terminals disposed in the housing with contacting sections exposed in the mating cavity and tail sections exposed under the bottom wall, wherein said opening further invades the bottom wall in the transverse direction so as to allow the mating cavity to communicate downwardly with the exterior in the vertical direction through said opening, wherein the bottom wall further defines another opening extending therethrough in the vertical direction and located adjacent to said one of the long side walls in the transverse direction and spaced from the opening in the longitudinal direction, and a guiding element is unitarily formed around a top side of said one of the long side walls in alignment with said another opening in the vertical direction.

4. The electrical connector as claimed in claim 3, wherein said guiding element is located around an end area of the protrusion in said longitudinal direction.

* * * * *